US010206482B2

(12) United States Patent
Sugita et al.

(10) Patent No.: US 10,206,482 B2
(45) Date of Patent: Feb. 19, 2019

(54) COSMETIC CONTAINER WITH INNER LID

(71) Applicant: Yoshida Industries Co., Ltd., Tokyo (JP)

(72) Inventors: Tomofumi Sugita, Tokyo (JP); Yumiko Hori, Tokyo (JP)

(73) Assignee: YOSHIDA INDUSTRIES CO., LTD., Tokyo (JP)

( * ) Notice: Subject to any disclaimer, the term of this patent is extended or adjusted under 35 U.S.C. 154(b) by 146 days.

(21) Appl. No.: 15/355,332

(22) Filed: Nov. 18, 2016

(65) Prior Publication Data

US 2017/0143098 A1 May 25, 2017

(30) Foreign Application Priority Data

Nov. 20, 2015 (JP) ..... 2015-227885

(51) Int. Cl.

| | |
|---|---|
| ***A45D 40/22*** | (2006.01) |
| ***A45D 33/00*** | (2006.01) |
| ***A45D 33/02*** | (2006.01) |
| ***A45D 33/24*** | (2006.01) |
| ***A45D 34/00*** | (2006.01) |
| ***B65D 43/16*** | (2006.01) |
| ***B65D 43/22*** | (2006.01) |
| *A45D 40/00* | (2006.01) |

(52) U.S. Cl.

CPC ..... *A45D 40/222* (2013.01); *A45D 33/008* (2013.01); *A45D 33/025* (2013.01); *A45D 33/24* (2013.01); *A45D 34/00* (2013.01); *A45D 40/22* (2013.01); *B65D 43/164* (2013.01); *B65D 43/22* (2013.01); *A45D 2040/0018* (2013.01); *A45D 2040/223* (2013.01); *A45D 2200/051* (2013.01)

(58) Field of Classification Search

CPC .... A45D 40/222; A45D 40/22; A45D 33/025; A45D 33/24; A45D 34/00; A45D 33/008; A45D 2040/223; A45D 2200/051; A45D 2040/0018; B65D 43/164; B65D 43/22

USPC ..... 132/293

See application file for complete search history.

(56) References Cited

U.S. PATENT DOCUMENTS

2009/0272399 A1* 11/2009 Kim ..... A45D 33/008 132/293

FOREIGN PATENT DOCUMENTS

| | | | |
|---|---|---|---|
| JP | H07-43575 | U | 9/1995 |
| JP | H09-191930 | A | 7/1997 |

(Continued)

OTHER PUBLICATIONS

English translation of JP 2014-83218. Espacenet Jun. 2018. http://translationportal.epo.org/emtp/translate/?ACTION=description-retrieval&COUNTRY=JP&ENGINE=google&FORMAT=docdb&KIND=A&LOCALE=en_EP&NUMBER=2014083218&OPS=ops.epo.org/3.2&SRCLANG=ja.*

*Primary Examiner* — James N Smalley
(74) *Attorney, Agent, or Firm* — Harness, Dickey & Pierce, P.L.C.

(57) ABSTRACT

A cosmetic container 1*a* has a container body having an opening above and being configured to store a cosmetic; an inner lid being configured to be attached to the container body; and a sealing lid being configured to hermetically seal the container body in a state having the inner lid attached. The inner lid includes a flat hollow cylindrical frame and a cosmetic penetrable fiber sheet having elasticity and attached to the frame under tension.

The frame is fitted to the container body with a lower end of the frame being apart from a bottom surface of the container body. The fiber sheet has a peripheral rim adhered from (Continued)

either an upper end surface or a lower end surface of the frame and along an inner circumferential face of the frame.

12 Claims, 6 Drawing Sheets

(56) References Cited

FOREIGN PATENT DOCUMENTS

| | | | | |
|---|---|---|---|---|
| JP | 2005-224398 | A | | 8/2005 |
| JP | 2008-194190 | A | | 8/2008 |
| JP | 2014083218 | A | * | 5/2014 |
| KR | 101112477 | B1 | | 2/2012 |
| KR | 20150010190 | A | | 1/2015 |

* cited by examiner

COSMETIC CONTAINER WITH INNER LID

CROSS-REFERENCE TO RELATED APPLICATIONS

The present application claims priority upon Japanese Patent Application No. 2015-227885 filed on Nov. 20, 2015, which is herein incorporated by reference.

BACKGROUND

Technical Field

The present invention relates to a cosmetic container having an inner lid provided with a cosmetic penetrable sheet material such as a net.

Related Art

A cosmetic container is known which has an inner lid attached to an upper end side of a container body and provided with an elastic net in a tensioned state. This cosmetic container is configured such that when the net is pushed downward with a puff or the like, the cosmetic contained in the container body penetrates through the net. And the user takes off the penetrated cosmetic with the puff and the like for use. Japanese Patent Application Laid-open publication No. 2005-224398 (literature 1), Japanese Patent Application Laid-open publication No. 2008-194190 (literature 2), Japanese Utility Model Application Publication No. Hei7-43575 (literature 3), and Japanese Patent Application Laid-open publication No. Hei9-191930 (literature 4), for example, describe such cosmetic containers.

In the inner lid used for conventional net equipped containers such as those described in literatures 1 to 3, an annular frame is used to hold the net. The inner peripheral portion of the frame is used to attach to the outer peripheral portion of the net and the outer peripheral portion of the frame is made to attach to the side of the container body such that the bottom outer circumference of the frame to come into intimate contact with the inner face of the cosmetic storing space of the container body. However, such structure may make it difficult for the cosmetic below the annular frame to be taken out through the net especially when the cosmetic has high viscosity. This will not allow the cosmetic to be used without waste. Even when the cosmetic is of low viscosity, the container body may have to be tilted so that the cosmetic is brought to the center below the annular frame. And this may lead to poor use of the cosmetic. The net equipped container disclosed in literature 4 has substantially only the space below the net used as the cosmetic storing space without providing any cosmetic storing space under the frame. Specifically this net equipped container has a thick frame supporting the net with the bottom end of the frame coming into contact with the bottom of the container body. This means that, the cosmetic storing space of the container body cannot be sufficiently used. In other words, a container larger than necessary is used for containing the same amount of cosmetic. Additionally, since the bottom end of the frame comes into contact with the bottom of the container body, the cosmetic may leak out from the container body through the interface where the inner face of the container body and the lower end face or the outer circumferential face of the frame come into contact when the contained cosmetic has a low viscosity.

A so-called "refill container" is also used as the cosmetic container. The refill container is used by being attached in a container (hereafter called "case") that serves as the outer cover body and this refill container is taken out of the case when the cosmetic inside the refill container becomes empty.

Thereafter the case can be reused by attaching in the case once again a newly purchased refill container in which cosmetic is filled. Many are so-called "compact cases" having a mirror on the back face the outer lid of the case where the compact cases themselves are made small and thin for portable use. As a matter of course, such compact cases have a reduced storing capacity and when the refill container is a net equipped container there arises a desire for allowing the cosmetic to be used without waste. Additionally, for a case where a net equipped container that usually does not have an airtight structure stores cosmetic in the case, the net equipped containers having air permeability require a hermetic structure that can close the opening of the container body in an airtight manner so that the cosmetic does not become dry. Further, measures require to be taken with the refill container for preventing the cosmetic from leaking out through the interface where the inner face of the container body and the outer circumferential face of the inner lid come into contact. This enables to overcome a problem where the cosmetic is stuck to the rim of the container body or the upper face of the net when a new refill container is opened spoiling the appearance of the new item which in turn annoying the user.

It is therefore an objective of the present invention to provide a cosmetic container allowing cosmetics to be used without waste as well as preventing unintended leaking of the cosmetics and also being appropriate as a refill container.

SUMMARY

Disclosed embodiments describe a cosmetic container including: a container body having an opening above and being configured to store a cosmetic; an inner lid being configured to be attached to the container body; and a sealing lid being configured to hermetically seal the container body in a state having the inner lid attached, wherein the inner lid comprises a flat hollow cylindrical frame and a cosmetic penetrable fiber sheet having elasticity and attached to the frame under tension, the frame is fitted to the container body with a lower end of the frame being apart from a bottom surface of the container body, and the fiber sheet has a peripheral rim adhered from either an upper end surface or a lower end surface of the frame and along an inner circumferential face of the frame.

Further, a disclosed embodiment relates to a cosmetic container, wherein the container body has formed to an inner face thereof a seat and the inner lid has the lower end of the frame supported by the seat while being attached with an outer circumferential surface thereof being in an intimate contact state with the inner surface of the container body.

The disclosed embodiment relates to cosmetic container, wherein the container body has an inner groove formed on the upper surface thereof encircling the opening and the inner lid is attached to the container body by the lower end side of the frame being inserted into the groove. Preferably, the frame of the inner lid includes a circular rim jutting inward at the upper end side thereof, and the fiber sheet has a circular peripheral portion adhered to the frame from the lower end of the rim, along the inner circumferential face and to a lower end of the frame.

The disclosed embodiment may relate to a cosmetic container, wherein the sealing lid hermetically seals the opening of the container body while engaging with the container body. Preferably, the sealing lid includes to a back face thereof an encircling wall that juts downward and an outer groove encircling the inner groove is formed to an upper end surface of the container body such that when the encircling wall is fitted into the outer groove, an inner circumferential side face of the groove is biased toward a radially inward direction to tighten an engagement of the frame of the inner lid with the inner groove.

Further, disclosed embodiment may relate to a cosmetic container, wherein the cosmetic container is detachably contained in an exterior case. Preferably, the container body is made to be enclosed in an exterior case and the sealing lid is provided to a back face of an outer lid configured to cover an opening of the exterior case and the back face of the outer lid is configured to seal in an air-tight manner the opening of the container body when the outer lid is closed.

Further, it is preferable that the cosmetic penetrable fiber sheet has a net structure.

Further, the cosmetic penetrable fiber sheet may be made of woven or knitted fiber sheet and the cosmetic to be contained in the container body may have low viscosity with fluidity.

BRIEF DESCRIPTION OF THE DRAWINGS

For a more complete understanding of the present disclosure and the advantages thereof, reference is now made to the following description taken in conjunction with the accompanying drawings wherein.

DESCRIPTION OF EXEMPLARY EMBODIMENTS

Figure 1:
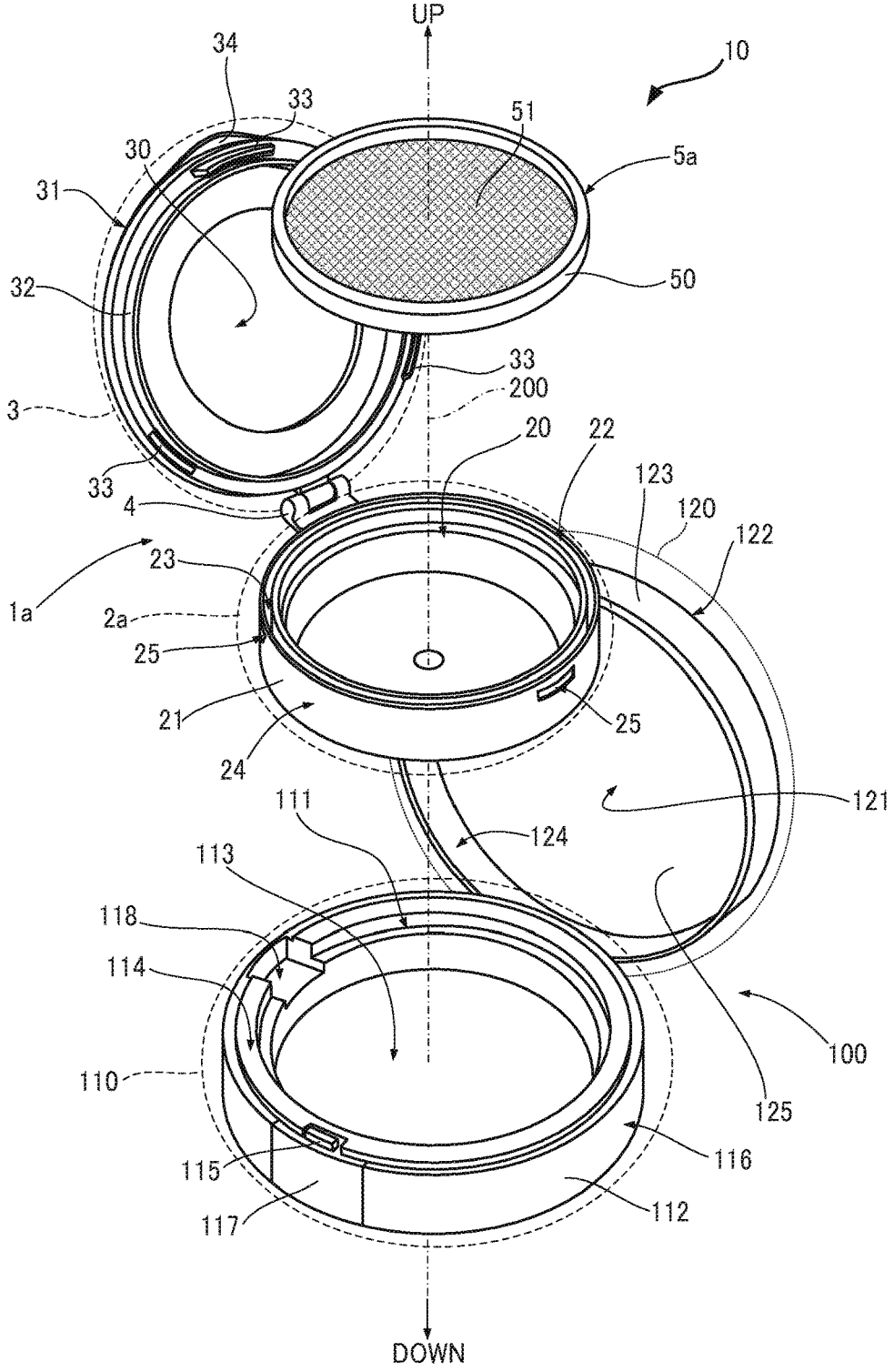
FIG. 1 is an exploded view of a compact type cosmetic container according to an embodiment of the present disclosure.

Embodiments of this disclosure will become clear through the description of the present specification and the accompanying drawings. The same reference numerals or signs will be used for the same or similar parts in the drawings used for the following explanation.

An Embodiment

As an embodiment of the present disclosure, FIG. 1 shows an exploded perspective view of a total of compact type container 10 according to an embodiment of the present disclosure. The compact type container 10 includes an exterior compact case 100 and a refill container 1*a*.

The exterior compact case 100 is configured with a refill container storing part 110, an outer lid 120, and a mirror 121 that is provided to an inner bottom face of the outer lid 120. The refill container storing part 110 is in a flat round box shape in which the refill container 1*a* is contained. The outer lid 120 allows opening and closing of the opening 111 of the refill container storing part 110 in a flat round box shape using a hinge not shown.

The refill container 1*a* includes a container body 2*a*, a sealing lid 3 and an inner lid 5*a* of frame type. The container body 2*a* stores cosmetic therein. The cosmetic to be stored in the container body 2*a* may be any type of cosmetic materials including cosmetics having low viscosity with high fluidity. The disc shaped sealing lid 3 covers the opening 20 of the container body 2*a* in an openable-closable manner with a hinge. The inner lid 5*a* of frame type is made to snugly fit to the opening 20 of the container body 2*a*. Further, the inner lid 5*a* is structured such that a net 51 made of a meshed material extends across inside the circular frame 50 (hereinafter called inner lid frame 50).

Although the net 51 is shown in the embodiment to be attached to the frame 50, other fiber sheet such as knitted or woven fiber sheet which can penetrate cosmetic materials having low viscosity with high fluidity can be used instead of the net. Preferable viscosity of the cosmetic to be used when the fiber sheet is used instead of net is in a range of 2,000 cP to 60,000 cP and more preferably in the range of 2,000 cP to 30,000 cP.

The direction of the normal 200 to the flat round box shaped refill storing part 110 of the compact case 100, the container body 2*a* of the refill container 1*a* and the circular surface of the inner lid 5*a* is defined as up-down direction. The up and the down directions are defined based on the assumption that the refill container 1*a* is attached inside the refill storing part 110 from above. With respect to the outer lid 120 and the sealing lid 3, the face facing outward when the compact case 100 is closed is defined as the top face (122, 31) and the face opposite the refill storing part 110 and the opening (111, 20) of the container body 2*a* is defined as the back face (121, 30.)

Based on the above-mentioned up-down and top-back definitions, the refill storing part 110 of the compact case 100 has an opening 111 on the upper end side of the thick circular frame (hereinafter called refill storing frame 112) and has the lower end closed to form the bottom surface 113. The outer lid 120 includes a circular frame (hereinafter called outer lid frame 123) closed at the top face 122 side and has a mirror 125 attached to the back face 121. The inner circumferential surface 124 of the outer lid frame 123 has an engaging structure (not shown) that engages with the protrusion 115 formed to the top end face 114 of the refill storing frame 112 and the compact case 100 is maintained closed when the outer lid 120 is closed using this engaging structure. Additionally, at the outer circumferential face 116 of the refill storing face 112, a button 117 for releasing the engagement with the outer lid 120 is attached flush with the outer circumferential face 116 at a location that corresponds to the position where the protrusion 115 is formed. There is formed to the top end face 114 of the refill storing frame 112 a recess 118 to which the hinge 4 of the refill container 1*a* is stored when the refill container 1*a* is attached.

The container body 2*a* is made of injection molding with a groove (hereinafter, hermetic groove 23) that is formed concentric with the opening 20 at the upper end surface 22 of the circular frame portion (hereinafter, main frame 21) of the container body 2*a*. A protrusion 32 that engages with this hermetic groove 23 is formed to the back face 30 of the sealing lid 3 in a circular wall shape. Here, the base end side of this protrusion (hereinafter, hermetic wall 32) is made wider than the width of the opening of the sealing groove 23 so that the container body 2*a* is air tightly sealed with the inner face of the hermetic groove 23 intimately contacting the outer face of the hermetic wall 32 when the sealing lid 3 is closed. Three protrusions (hereinafter, engaging wall 33) are formed to the back face 30 of the circular plate-shaped sealing lid with parts of engaging wall 33 being concentric with the hermetic wall 32 and are placed at same angular intervals so to form a structure that engage with the depressions (hereinafter, engaging depressions 25) formed at the outer circumferential face 24 of the main frame 21 of the container body 2*a*. Additionally, a flap 34 for the fingers to pull open this sealing lid 3 is formed to the edge of the sealing lid 3 at a part opposite the hinge 4.

Figure 2A:
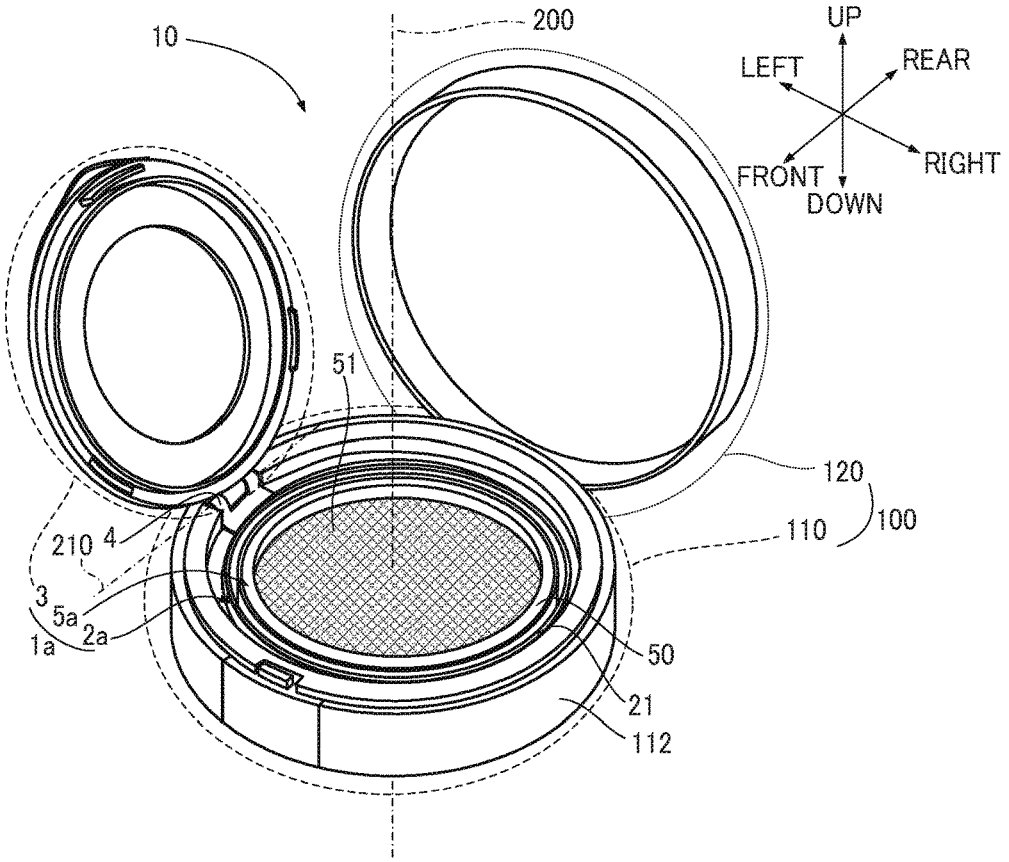
FIG. 2A is a diagram showing an assembled compact type cosmetic container according to an embodiment.
Figure 2B:
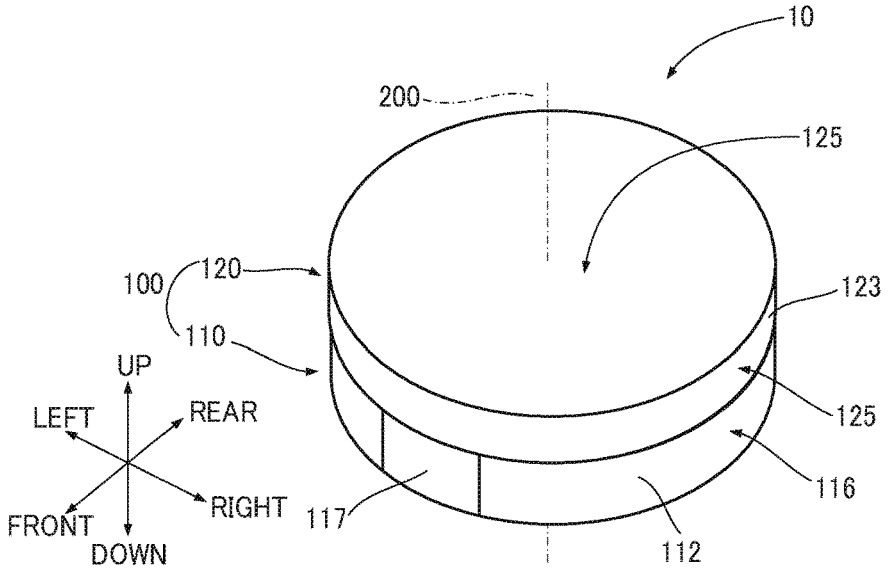
FIG. 2B is a diagram showing an assembled compact type cosmetic container according to an embodiment.

FIGS. 2A to 2C illustrate diagrams of the compact case 100 storing the refill container 1*a*. FIG. 2A illustrates both the outer lid 120 and the sealing lid 3 in opened states and FIG. 2B illustrates both the outer lid 120 and the sealing lid 3 in closed states. As illustrated in FIG. 2A, the directions in which the outer lid 120 and the sealing lid 3 open and close intersect with each other, so that both of the lids (120, 3) can be maintained open without coming into contact with each other. In this example, the directions in which the outer lid 120 and the sealing lid 3 open and close are orthogonal to each other. The direction of the rotation axis 210 of the hinge 4 of the sealing lid 3 is set as the front-rear direction in the following description. In other words, the direction of the rotation axis of the unshown hinge of the outer lid 120 is in the right-left direction. And when the hinge 4 of the sealing lid 3 is on the left side and the hinge of the outer lid 120 is on the rear side, the right-left and the front-rear directions in addition to the up-down direction are defined as illustrated in the drawings. When the outer lid 120 is closed as illustrated in FIG. 2B, the outer circumferential faces (125-116) of the outer lid frame 123 and the refill storing frame 112 are in flush so to exhibit a flat cylindrical outer feature.

<Structure of Refill Container>

Figure 3A:
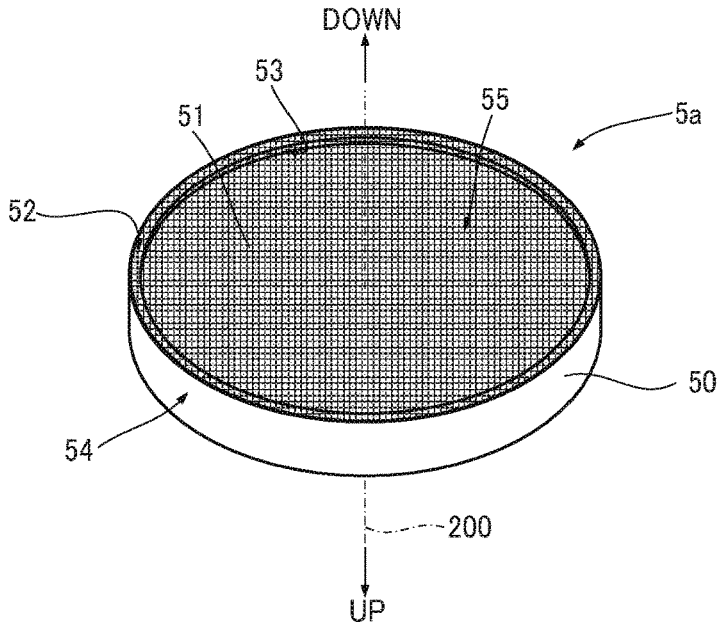
FIG. 3A is a diagram showing a structure of an inner lid that configures an embodiment and how the inner lid of the present embodiment is attached in the embodiment.
Figure 3B:
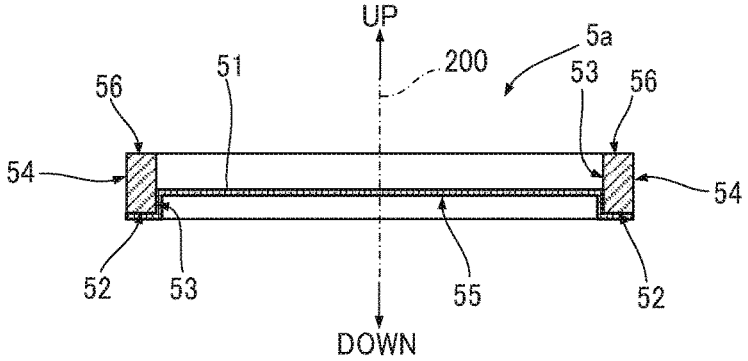
FIG. 3B is a diagram showing a structure of an inner lid that configures an embodiment and how the inner lid of the present embodiment is attached in the embodiment.
Figure 3C:
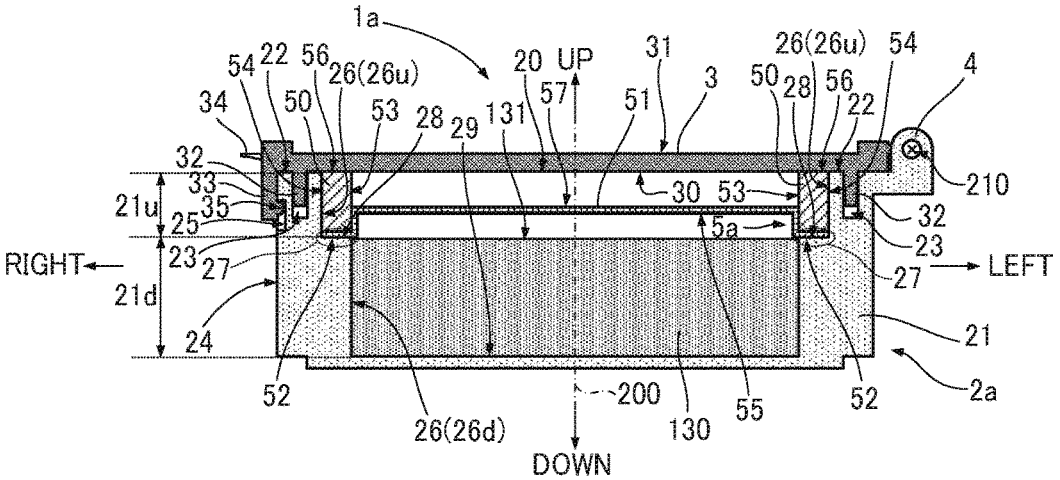
FIG. 3C is a diagram showing a structure of an inner lid that configures an embodiment and how the inner lid of the present embodiment is attached in the embodiment.

FIGS. 3A to 3C are diagrams showing structures of the refill container according to an embodiment. FIG. 3A is a perspective view when the inner lid 5*a* is seen from below and FIG. 3B is a vertical sectional view of the inner lid 5*a* cut along a face in the up-down direction. FIG. 3C is a vertical sectional view of the refill container 1*a* showing the vertical section of the refill container 1*a* including the hinge 4 when seen along the direction of the rotation axis 210 of the hinge 4 which extends in the direction perpendicular to the plane of the paper. As illustrated in FIGS. 3A and 3B, the inner lid 5*a* is basically structured so that the net 51 is adhered to the bottom surface 52 of the inner lid frame 50 under tension. Namely, the net 51 has a circumferential horizontal outer end part adhered to the bottom surface 52 of the inner lid frame 50 and also has a vertical circumferential inner rim part, which is contiguous to the horizontal end part, adhered to the inner circumferential surface 53 of the inner lid frame 50. The refill container 1*a* according to this embodiment has sufficient adhering force with a large adhering area between the inner lid frame 50 and the net 51.

As illustrated in FIG. 3C, the container body 2*a* in the closed state is hermetically sealed as the hermetic wall 32 located on the back face of the sealing lid 3 is pressed in the hermetic groove 23 formed to the top surface 22 of the container body 2*a*. A protrusion 35 formed to the inner face of the engaging wall 33 engages with the engaging depression 25 of the container body 2*a* to maintain the closed state. The inner lid 5*a* is inserted inside the main frame 21 to snugly fit therewith and the outer circumferential face 54 of the inner lid 5*a* comes to be in intimate contact with the inner circumferential surface 26 of the container body 2*a*. To be specific, the inner side of the main frame 21 is shaped as a flat two staged column having the diameter of the lower side reduced. And the main frame 21 includes a cylindrical area 21*u* forming the upper step and a cylindrical area 21*d* forming the lower step. Here, a "seat" is formed with the top surface 28 of the step 27 supporting from below the bottom surface 52 of the inner lid 5*a*. And when the inner lid 5*a* is in a state inserted in the container body 2*a*, the outer circumferential face 54 of the inner lid frame 50 and the inner circumferential surface 26*u* of the upper stage cylindrical area 21*u* of the main frame 21 are in intimate contact. And in addition, the inner circumferential vertical surface 53 of the inner lid frame 50 and the inner circumferential vertical surface 26*d* of the lower step cylindrical area are in flush. Hereby, when the cosmetic 130 is stored in the container body 2*a*, the entire bottom surface 55 area of the net 51 that is inside the inner lid frame 50 opposes the entire area of the top surface 131 of the cosmetic 130. Therefore, when the net 51 is pushed downward, the bottom surface 55 of the net 51 also comes into contact with the cosmetic 130 that is inside the inner circumferential surface 26 of the container body 2*a* allowing the cosmetic 130 to be taken out effectively. In other words, the cosmetic 130 can be used up without waste. Further, the circumferential rim of the net 51 is adhered with sufficient adhering strength at a wide area along the bottom surface 52 to the inner circumferential surface 53 of the inner lid frame 50 so that the net does not come off from the inner lid frame 50 even when the net is pushed deep downward. Furthermore, the refill container 1*a* according to the embodiment forming the storing space of the cosmetic 130 from the bottom surface 29 to the aforementioned step 27 of the container body 2*a* allows the top surface 131 of the cosmetic 130 to be always below the bottom surface 52 of the inner lid frame 50 so that the cosmetic 130 does not stick to a part above the aforementioned step 27 when filling the cosmetic. That is, the cosmetic 130 does not leak out from the top side of the container body 2*a* through the interface 26*u* where the outer circumferential face 54 of the inner lid frame contacts the inner circumferential surface of the hollow cylindrical area 21*u* on the upper stage side of the container body 2*a*. It is a matter of course that the amount of the cosmetic 130 gradually decreases so that the top surface 131 thereof comes below the bottom surface 52 of the inner lid frame 50 during the course of the cosmetic 130 being taken out through the net 51 thereby allowing a low possibility of the cosmetic 130 to leak out during the continuing use of the refill container 1*a*. The refill container 1*a* according to the embodiment has the top surface 56 of the inner lid frame 50 located above the top surface 57 of the net 51. Therefore, the back face 30 of the sealing lid 3 does not come into contact with the net 51 even when the sealing lid 3 is closed. And thus the cosmetic 130 stuck to the top surface 57 side of the net 51 does not stick to the back face 30 of the sealing lid 3 when the cosmetic 130 is taken out. And as a result, the cosmetic 130 does not stick to an unintended place by the back face 30 coming into contact with the user's clothes and fingers when using the cosmetic 130.

Another Embodiment

In the above described embodiment, the cosmetic that was filled to the position of the step 27 inside the container body was kept from leaking out from between the interface of the container body and the outer circumferential face of the inner lid frame. However in this case, the space between the step 27 and the bottom surface of the net could not be used as the cosmetic storing space. Another embodiment provides a refill container that can be filled with cosmetic to the lower face of the net and even up close to the top of the inner lid frame while avoiding the cosmetic from leaking.

Figure 4A:
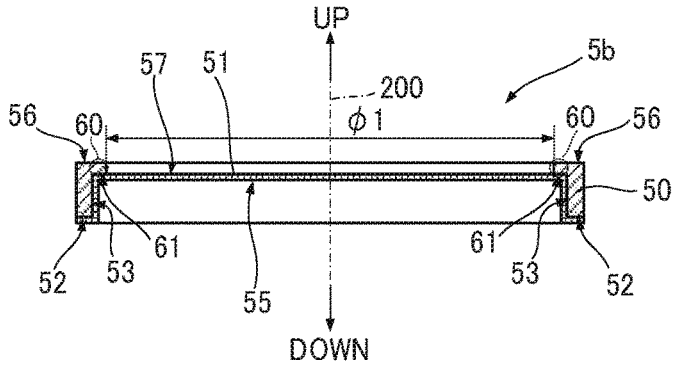
FIG. 4A is a diagram showing a structure of an inner lid according to another embodiment of the present disclosure.
Figure 4B:
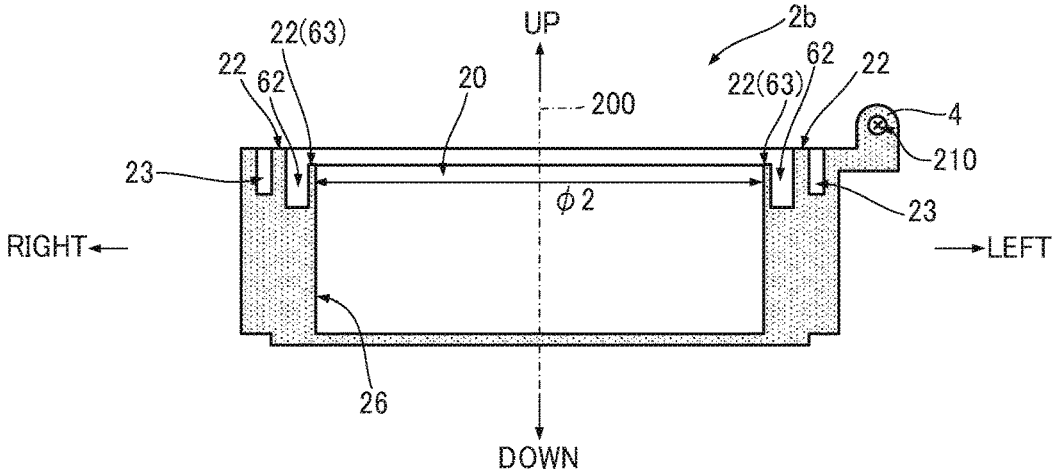
FIG. 4B is a diagram showing a structure of a cosmetic container according to another embodiment of the present disclosure.
Figure 4C:
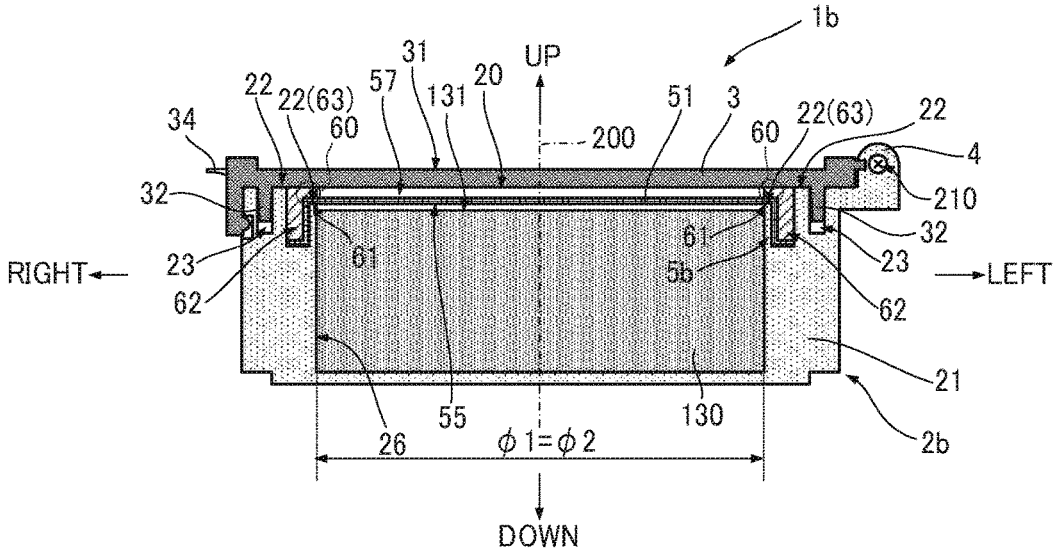
FIG. 4C is a diagram showing a structure of a cosmetic container according to another embodiment of the present disclosure.

FIGS. 4A to 4C illustrate another embodiment of the present invention. FIG. 4A illustrates a vertical sectional view of an inner lid 5*b* to be assembled in the refill container according to another embodiment. FIG. 4B illustrates a vertical sectional view of a container body 2*b* including the hinge 4. FIG. 4C illustrates a vertical sectional view including the hinge 4 when the refill container 1*b* is closed. As illustrated in FIG. 4A, the inner lid 5*b* has formed a rim 60 jutting inward at the top surface of the inner lid frame 50. The peripheral portion of the net 51 is adhered to the inner frame 50 all the way from a horizontal bottom surface of the frame 50 to a horizontal bottom surface of the rim 60 through a vertical inner surface 53 of the frame 50. The area inside the internal diameter ϕ1 shown in FIG. 4A is substantially open. As illustrated in FIG. 4B, a recess (hereinafter engaging groove 62) shaped as a groove that is concentric with a hermetic groove 23 is formed, inside the hermetic groove 23, to the upper end surface 22 of the main frame 21 of the container body 2*b*. And an opening 20 with an internal diameter of ϕ2 is formed inside this engaging groove 62. As illustrated in FIG. 4C, the bottom surface 52 side of the inner lid frame 50 adhered with the peripheral portion of the net is inserted into the engaging groove 62. Additionally, the bottom surface 61 of the rim 60 of the inner lid frame 50 comes into contact with the top surface 63 that is on the inner circumferential side wall of the engaging groove 62. Here the internal diameter ϕ1 of the rim 60 is identical to the internal diameter ϕ2 of the upper end surface 22 of the container body 2*b*.

In this way, the refill container 1*b* according to the another embodiment has the inner lid frame 50 inserted in the engaging groove 62 of the container body 2*b* so that the inner circumferential surface 53 of the inner lid frame 50 is not exposed to the inner circumferential surface 26 of the container body 2*b*. Hereby, substantially the entire capacity of the container body 2*b* can be used as the area for filling the cosmetic 130 as long as the top surface 131 of the cosmetic 130 comes below the bottom face 55 of the net 51. Additionally, in principle, the cosmetic does not leak out through the interface where the outer circumferential face 54 of the inner lid frame 50 contacts the inner circumferential surface 26 of the container body 2*a*. The top surface 56 of the inner lid frame 50 comes above the top surface 57 of the net 51 in also the case of the refill container 1*b* according to the another embodiment so that an unintended sticking of the cosmetic to the net can be avoided.

Other Embodiments

In the first embodiment the container body had the inside step which acts as the seat that supports from below the inner lid, however, ribs extending in the up-down direction may be formed at several places at the inner circumferential surface of the container body for the upper ends of the ribs to perform a role as the seat. Alternatively, a canopy shaped protrusion jutting inward in the container body may be formed to be used as the seat.

The first and the second embodiments were structured such that the opening of the container body was air-tightly sealed by allowing the hermetic wall formed to the bottom surface of the sealing lid to engage the hermetic groove formed to the upper end surface of the ° body frame. In order to reinforce the hermetic state inside the container body with this sealing structure, the surface that comes into contact with the outer circumferential surface of the inner lid may be biased outward with the inner lid frame being attached to the container body. Hereby, the tightly sealed state between the engaging groove and the hermetic wall can be reinforced. In the first embodiment, the outside diameter of the inner lid frame may be made larger than the internal diameter at the upper step side of the container body. In the second embodiment, the outside diameter of the inner lid frame can be made larger than the internal diameter of the outer circumferential side wall face of the engaging groove.

Figure 5A:
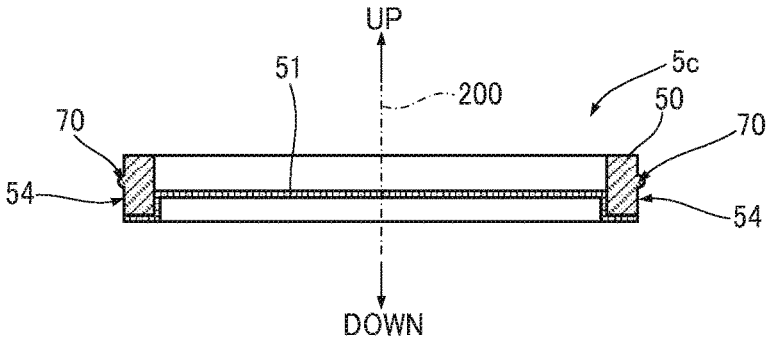
FIG. 5A is a diagram showing a modified example of an inner lid according to an embodiment of the present disclosure.
Figure 5B:
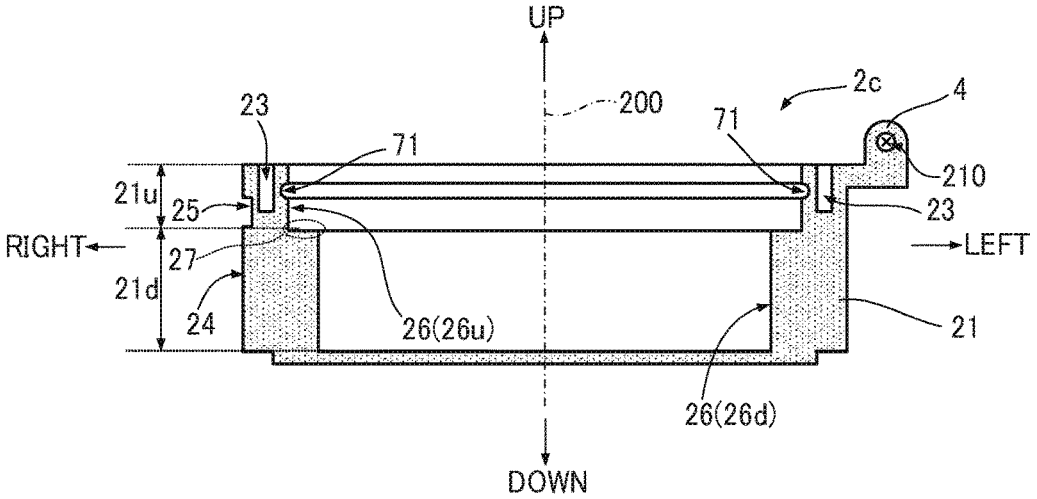
FIG. 5B is a diagram showing a modified example of the cosmetic container according to an embodiment of the present disclosure.
Figure 5C:
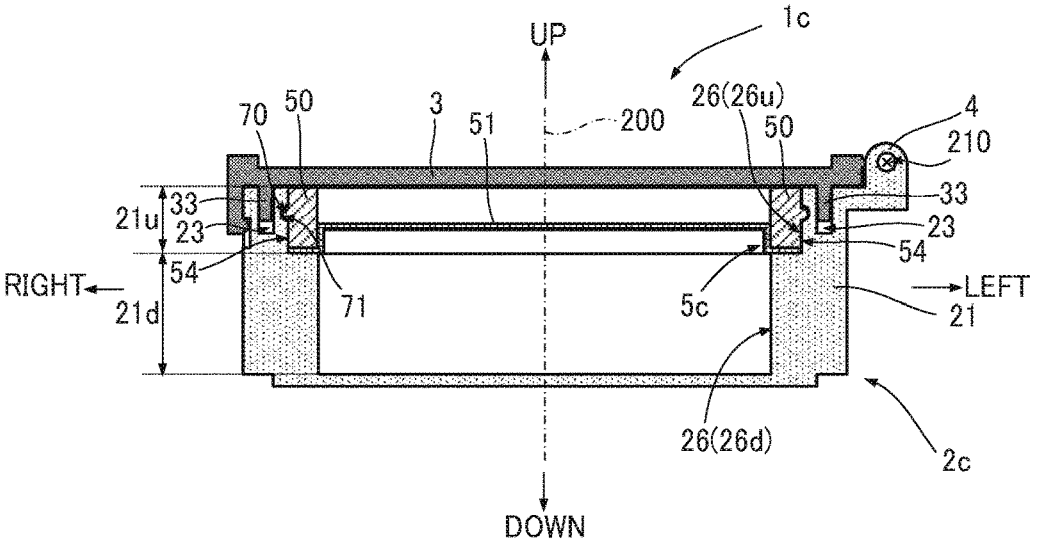
FIG. 5C is a diagram showing a modified example of the cosmetic container according to an embodiment of the present disclosure.

The first and second embodiments had the inner lid attached by fitting the inner lid into the container body. However, an engaging structure may be provided between the container body and the inner lid frame to avoid the inner lid from falling out during use. The engaging structure between the inner lid and the container body is shown in FIGS. 5A to 5C. FIGS. 5A and 5B each illustrate vertical sectional views of the inner lid 5*c* and the container body 2*c*, and FIG. 5C illustrates a vertical sectional view of the refill container 1*c* in a closed state. The refill container 1*c* illustrated in FIGS. 5A to 5C is a modified example of the container body according to an embodiment. Here, as illustrated in FIG. 5A, the inner lid 5*c* has formed a protrusion 70 that encircles the outer circumferential surface 54 of the inner lid frame 50. Additionally, as illustrated in FIG. 5B, to the inner circumferential surface 26 of the container body 2*c*, a groove 71 that engages with the aforementioned protrusion 70 is formed to the inner circumferential surface 26*u* of the upper stage cylindrical area 21*u* that opposes the outer circumferential surface 54 of the inner lid 5*c*. Further, as illustrated in FIG. 5C, the protrusion 70 of the inner lid frame 50 engages with the groove 71 of the inner circumferential surface 26 of the container body 2*c* so that the inner lid 5*c* does not easily come off when the inner lid 5*c* is closed. It is a matter of course that the relation between the protrusion and the groove can be reversed. In the second embodiment, a similar engaging structure may be provided between the inner circumferential surface on the outside diameter side of the engaging groove and the outer circumferential surface of the inner lid frame.

Figure 6:
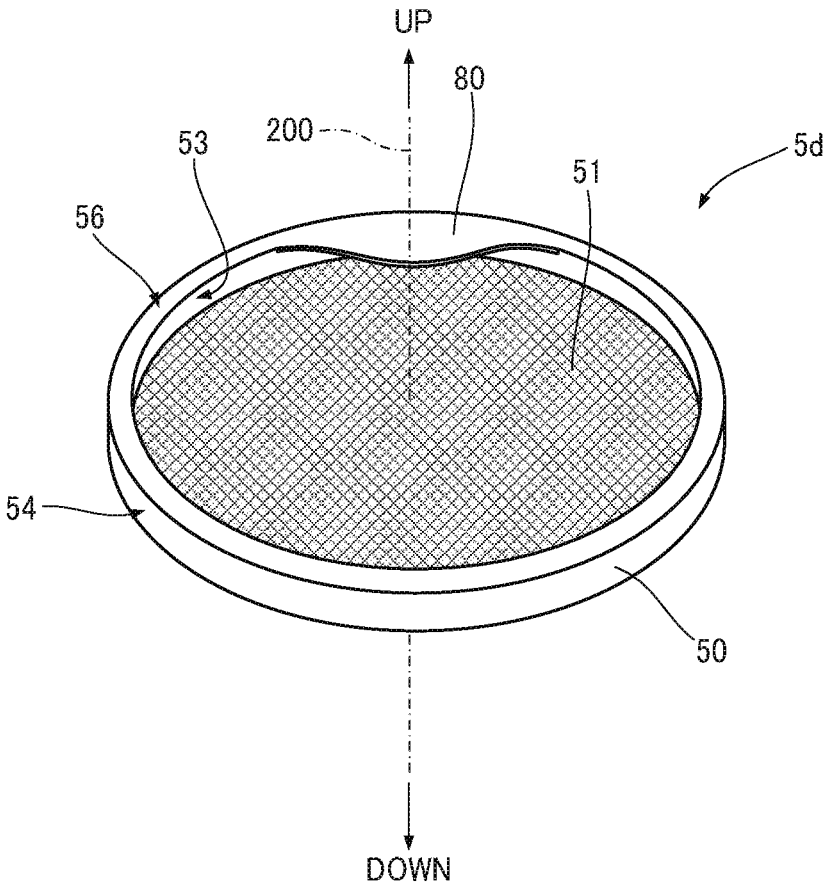
FIG. 6 is a diagram showing a structure of the inner lid including a cosmetic container according to another embodiment of the present disclosure.

Basically, the inner lid does not need to be removed during use since the refill container is changed with a new one when the cosmetic in the refill container becomes empty, however, there remains a possibility that the inner lid is be removed. The inner lid cannot be removed easily since the inner lid is attached in a fit state in a manner such that the inner lid does not unintendedly come off and also such that the cosmetic is avoided from leaking out through the interface between the container body. Particularly, the user's hand or fingers cannot catch the inner lid when the top end face of the frame does not jut out from the circumferential rim of the container body opening. Being the case, a flap (tab 80) that juts inward from the inner circumferential surface 53 may be provided to the upper end side of the inner lid frame 50 such as that with the inner lid 5*d* illustrated in FIG. 6.

The inner lid frame may be formed with a soft material that can deform elastically and the upper end surface of this inner lid may be configured to jut out upward above the circumferential rim of the container body opening when the inner lid frame is attached to the container body. Hereby, the portion jutting out can be sandwiched by fingers from both end sides of the inner lid frame diameter to allow the inner lid frame to deform when pushing to bias inward from both sides to thereby allowing an easy removal of the inner lid.

The hermetic structure of the container body is not limited to the above described embodiments and, for example, a packing in an O-ring form may be placed on the upper end surface of the container body so to have the interior of the container body hermetically sealed by the back face of the sealing lid coming into intimate contact with the upper end surface of the O-ring when the sealing lid is closed. Further, a hermetic wall may be provided to the back face of the outer lid without connecting the sealing lid to the container body and allowing the outer lid to function as a sealing lid.

In the above described embodiments, the circular rim of the net was continuously adhered from the bottom end and along the inner face of the frame so that only the net tensioned area inside the frame was seen from above giving a beautiful appearance. It is a matter of course that the frame can be placed upside down as long as the frame can be fit to the container body. In this case, the circular rim of the net is continuously adhered from the upper end surface to the inner face of the frame even when the frame is positioned upside down so that the upper end of the frame protrudes above the tensioned net surface. This does not allow the back face of the sealing lid to come into contact with the tensioned net surface which in turn makes it difficult for the cosmetic to stick onto this back face. That is, unintended sticking of cosmetics to the hands and fingers or clothes can be avoided.

The inner lid frame need not be in an annular form and the inner lid frame may be a rectangular frame. The shape of the inner surface area to which the inner lid is attached in the container body may be any shape as long as the shape of the inner surface area agrees with the shape of the inner lid. Further, the sealing lid and the container body were connected with a hinge, however, another configuration may be used. A refill container was given as an example of a net equipped container according to the embodiments of the present disclosure, however, the use and the shape of the tightly closable cosmetic container including a net equipped inner lid is not limited as long as the configuration thereof allows the opening of the container body to be sealed in an air-tight manner. The configuration may not have an exterior case.

What is claimed is:

1. A cosmetic container comprising:

a container body having an opening above and being configured to store a cosmetic;

an inner lid being configured to be attached to the container body; and a sealing lid being configured to hermetically seal the container body in a state having the inner lid attached, wherein the inner lid comprises a flat hollow cylindrical frame and a cosmetic penetrable fiber sheet having elasticity and attached to the frame under tension, the frame is fitted to the container body with a lower end of the frame being apart from a bottom surface of the container body the fiber sheet has a peripheral rim adhered from either an upper end surface or a lower end surface of the frame and along an inner circumferential face of the frame; and the sealing lid includes to a back face thereof an encircling wall that juts downward and an annular groove is formed to an upper end surface of the container body such that when the encircling wall is fitted into the annular groove, an inner circumferential side face of the annular groove outside the frame of the inner lid is biased toward a radially inward direction to tighten an engagement between the frame of the inner lid and the container body.

2. The cosmetic container according to claim 1, wherein the container body has formed to an inner face thereof a seat and the inner lid has the lower end of the frame supported by the seat while being attached with an outer circumferential surface thereof being in an intimate contact state with the inner surface of the container body.

3. The cosmetic container according to claim 1, wherein the container body has an inner groove formed on the upper surface thereof encircling the opening and the inner lid is attached to the container body by the lower end side of the frame being inserted into the groove.

4. The cosmetic container according to claim 3, wherein the frame of the inner lid includes a circular rim jutting inward at the upper end side thereof, and the fiber sheet has a circular peripheral portion adhered to the frame from the lower end of the rim, along the inner circumferential face and to a lower end of the frame.

5. The cosmetic container according to claim 1, wherein the sealing lid hermetically seals the opening of the container body while engaging with the container body.

6. The cosmetic container according to claim 1, wherein a face of the container body configured to come into contact with the outer circumferential side of the frame is biased outward while the frame is attached to the container body to reinforce the intimate contact state between the annular groove and the encircling wall.

7. The cosmetic container according to claim 1, wherein the cosmetic container is detachably contained in an exterior case.

8. The cosmetic container according to claim 1, wherein the container body is made to be enclosed in an exterior case and the sealing lid is provided to a back face of an outer lid configured to cover an opening of the exterior case and the back face of the outer lid is configured to seal in an air-tight manner the opening of the container body when the outer lid is closed.

9. The cosmetic container according to claim 1, wherein the cosmetic penetrable fiber sheet has a net structure.

10. The cosmetic container according to claim 1, wherein the cosmetic penetrable fiber sheet is made of woven or knitted fiber sheet and the cosmetic to be contained in the container body has low viscosity with fluidity.

11. The cosmetic container according to claim 3, wherein the sealing lid hermetically seals the opening of the container body while engaging with the container body.

12. The cosmetic container according to claim 3, wherein a face of the container body configured to come into contact with the outer circumferential side of the frame is biased outward while the frame is attached to the container body to reinforce the intimate contact state between the outer groove and the encircling wall.

* * * * *